US007348478B1

(12) United States Patent
Lombardi

(10) Patent No.: US 7,348,478 B1
(45) Date of Patent: Mar. 25, 2008

(54) TAMBOURINE CONNECTION TO SUPPORT STRUCTURE

(75) Inventor: Donald G. Lombardi, Westlake Village, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 11/586,100

(22) Filed: Oct. 26, 2006

(51) Int. Cl.
*G10D 13/08* (2006.01)

(52) U.S. Cl. ..... 84/402

(58) Field of Classification Search ..... 84/418, 84/422.1, 422.2, 422.3
See application file for complete search history.

(56) References Cited

U.S. PATENT DOCUMENTS 3,481,239 A * 12/1969 Blumenfeld ..... 84/418
6,399,864 B1 * 6/2002 Willcutt ..... 84/418

* cited by examiner

*Primary Examiner*—Kimberly Lockett
(74) *Attorney, Agent, or Firm*—William W. Haefliger

(57) ABSTRACT

A tambourine structure comprising in combination a frame extending at least in part along an extended path, multiple jingles carried by the frame at selected locations along said path, and means carried by the frame to connect the frame to support structure selectively in each of at least two different positions.

12 Claims, 3 Drawing Sheets

TAMBOURINE CONNECTION TO SUPPORT STRUCTURE

BACKGROUND OF THE INVENTION

This invention relates generally to tambourines, and more particularly to supporting of tambourines in relatively different positions to be struck as by a drumstick.

A tambourine typically comprises:

a) a frame extending at least in part along an extended path, b) multiple jingles-carried by the frame at selected locations along said path.

There is need for means carried by the frame to connect the frame to support structure selectively in each of at least two different positions, whereby the tambourine can be most easily struck as by a drumstick, used by a drummer. The position of the drummer relates to the tambourine to be played, can then be varied in accordance with drumming demands.

SUMMARY OF THE INVENTION

It is a major object of the invention to meet the above need, by provision of such a means characterized by providing two such positions, characterized as:

i) frame substantially horizontal position, ii) frame substantially vertical position.

It is a further object to provide such means in the form of first and second clamping elements corresponding to said two different positions. The clamping elements are typically oriented to be selectively employed in conjunction with a stand having an upright rod to be clamped by either of the first and second clamping elements, depending upon desired selected positioning of the tambourine, i.e. its frame.

Yet another object is to provide each of the first and second clamping elements to have a fixed clamping element and a movable clamping element, said elements defining V-shaped grooves to receive said support structure therebetween.

An added object is to provide the fixed clamping elements to be connected to the tambourine handle. As will be seen, the fixed clamping elements include two pairs of parallel projections, one pair projecting vertically and the other pair projecting horizontally, each movable clamping element received on one of said pairs, for clamping advancement toward the fixed element.

Yet another object is to provide the projection in the form of threaded members for tightening the movable element against the rod, in said different positions. The threaded members typically having threaded connection to the movable elements for advancing them toward the fixed elements in response to rotation of the members.

The method of use of the invention includes attaching one of the first and second clamping elements to the support and so that the tambourine extends in one position, playing the tambourine, then detaching said one of the clamping elements from the support and attaching the other of the first and second clamping elements to the support rod so that the tambourine extends in another position, and playing the tambourine. Preferably, the one position is horizontal, and the other position is vertical.

These and other objects and advantages of the invention, as well as the details of an illustrative embodiment, will be more fully understood from the following specification and drawings, in which:

DRAWING DESCRIPTION

DETAILED DESCRIPTION

Figure 3:
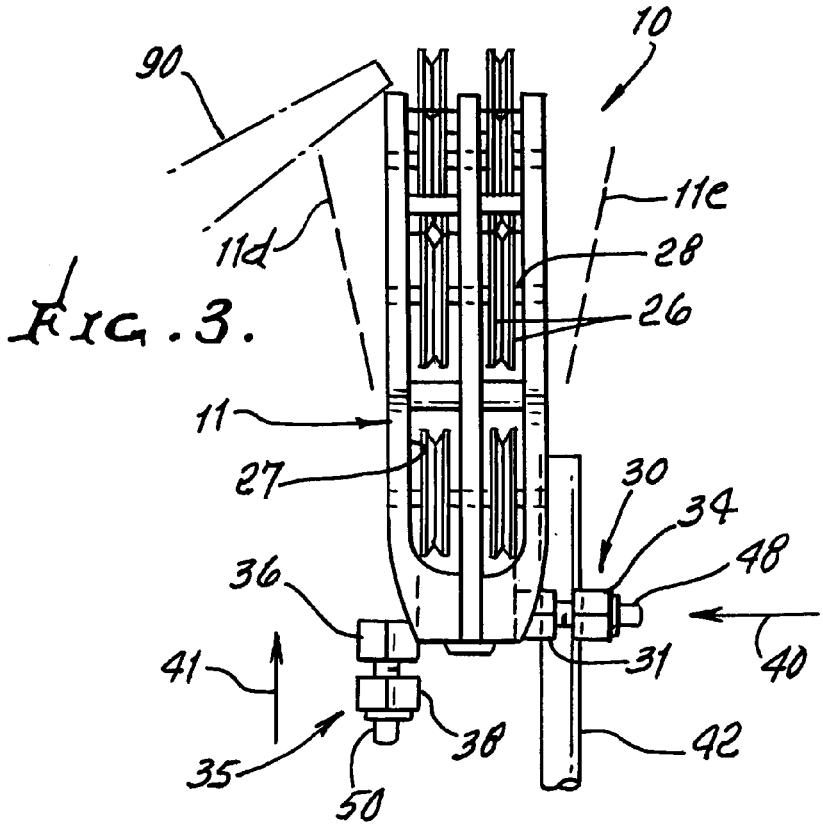
FIG. 3 is an elevation taken on FIG. 1, showing the tambourine supported to extend vertically.
Figure 4:
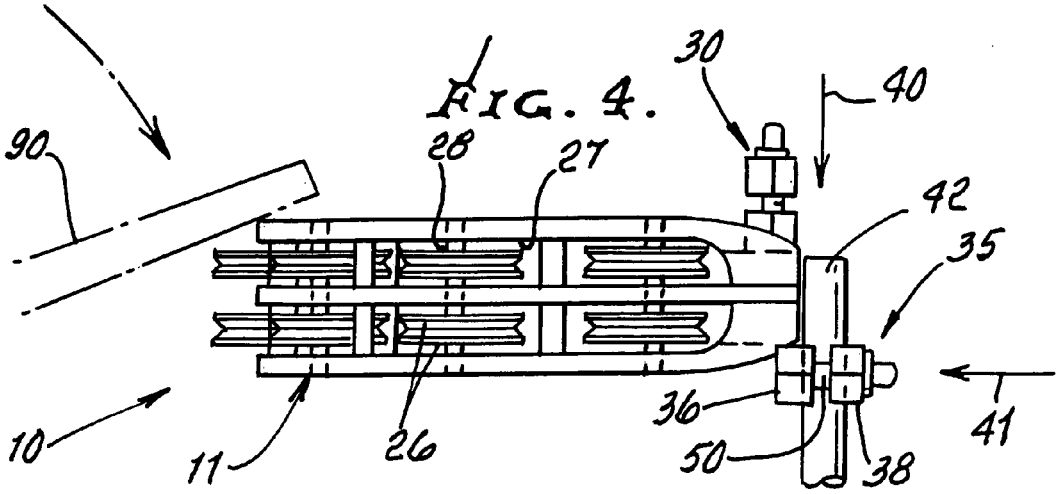
FIG. 4 is an elevation view like FIG. 3, but showing the tambourine supported to extend horizontally.

In FIGS. 1-4 a tambourine 10 has a frame 11 that forms a generally crescent overall shape, and which includes a first portion 11*a* that extends in part along a looping path A--G between corners 12 and 13. Path A--G is outwardly convex, as shown. The frame has a re-entrant portion 11*b* that extends along path H--K between corners 12 and 13. That path is outwardly concave. Portion 11*b* includes a handle indicated at 14, close to the center of gravity of the tambourine. Shaking the tambourine back and forth causes jingles 20 to produce their characteristic jingling sound. They also produce a sudden impact sound when the tambourine frame is impacted as by a drumstick 90 as seen in FIGS. 3 and 4.

Figure 1:
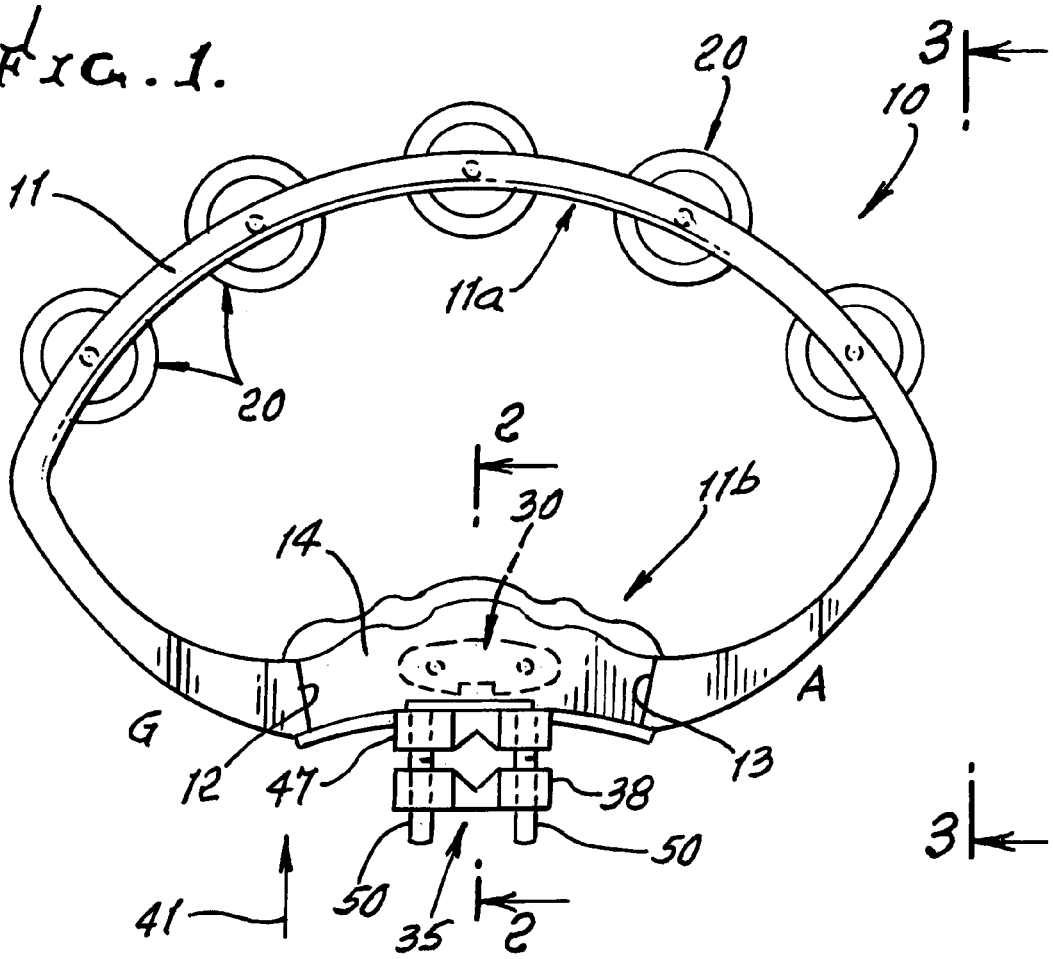
FIG. 1 is a frontal view of a tambourine incorporating the invention.
Figure 2:
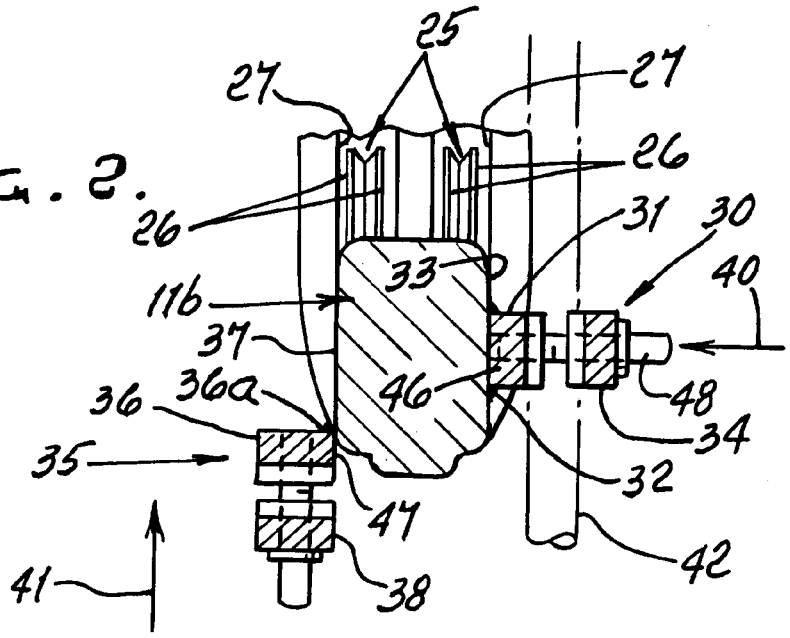
FIG. 2 is an enlarged section taken on lines 2-2 of FIG. 1.

The jingles 20 may comprise pairs 25 of like metallic discs 26 carried within slots 27 of the frame. The pairs of discs are loosely received on carrier pins 28 attached to the frame, as is clear from FIG. 3, whereby the thin metallic discs of each pair slide back and forth on the pins and strike each other to produce the characteristic jingling sound, represented by an audible frequency range $f_1$ to $f_2$, as the tambourine is struck. The jingles are carried at selected locations along the frame path or paths, as seen in FIG. 1. Two pairs of jingles may be carried at each selected location, as is clear from FIG. 2, two slots 27 formed in the frame at such locations. Pins 28 extend normal to the plane of the frame. See also U.S. Pat. No. 6,127,614 incorporated herein by reference.

Figure 7:
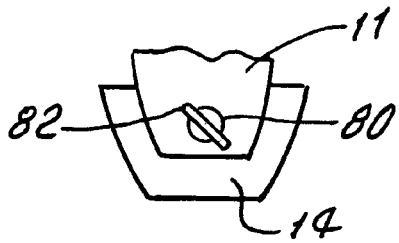
FIG. 7 shows modification.

In accordance with the invention, means is carried by the frame to connect the frame to support structure selectively in each of at least two different positions. Examples of two different positions are shown at FIG. 3, wherein the tambourine 10 and frame 11 extends generally vertically and FIG. 4 is which the tambourine and frame 11 extend generally horizontally. The drumstick 90 is shown impacting the tambourine in each such position (as opposed to normal shaking of the tambourine). Such different position of adjusted tambourine positioning can accommodate the equipment to close by location of other percussion instrument equipment, and to the drummer's positioning, a result that is highly desired. FIG. 7 shows a modification in which the tambourine frame is tiltable, as between broken line positions 11*d* and 11*e* in FIG. 3. See pivot 80 about which the frame 11 is adjustably tilted relative to handle 14, clasped to rod 42 as will appear. A clasp screw handle 82 clasps the frame to the handle in tilted position.

The connection means as referred to typically includes first and second clamping elements or devices corresponding to such two positions, see for example the first clamping element or device 30 that includes a fixed element 31 attached at 32 to the side 33 of the handle, and a part or element 34 movable in direction 40 toward part 31. See also, for example the second clamping device or element 35 or device that includes a fixed part or element 36 attached at 36*a* to the side 37 of the handle, and a part or element 38 movable in direction 41 toward part 36. Directions 40 and 41 extend at substantially 90° relative to one another, direction 40 being horizontal and direction 41 being vertical. Note also percussion instrument support rod 42 extending vertically in FIG. 3 and gripped by first device 30, and the rod 42 in FIG. 4 grasped by second device 35.

The first device fixed element 31 includes a base 46 and two parallel projections or guides 48 and carried by 46 to project parallel to direction 40; and likewise, the second device fixed element 35 includes a base 47 and two parallel projections or guides 50 carried by base 47, to project parallel to direction 41. The part 34 is movable on projections 48 to effect clamping of rod 42 between V-clamp surface 46*a* on base 46 and 34*a* on part 34 and surface 34*a* on part 34; and when the frame is rotated 90° to FIG. 4 position, the part 38 is movable on projections 50 to effect clamping of rod 42 between V-clamp surfaces on parts 36 and 38. Projections 48 and 50 may comprise threaded members, as shown, that interfit, the guides being tightenable to effect part movement and clamping.

Figure 5:
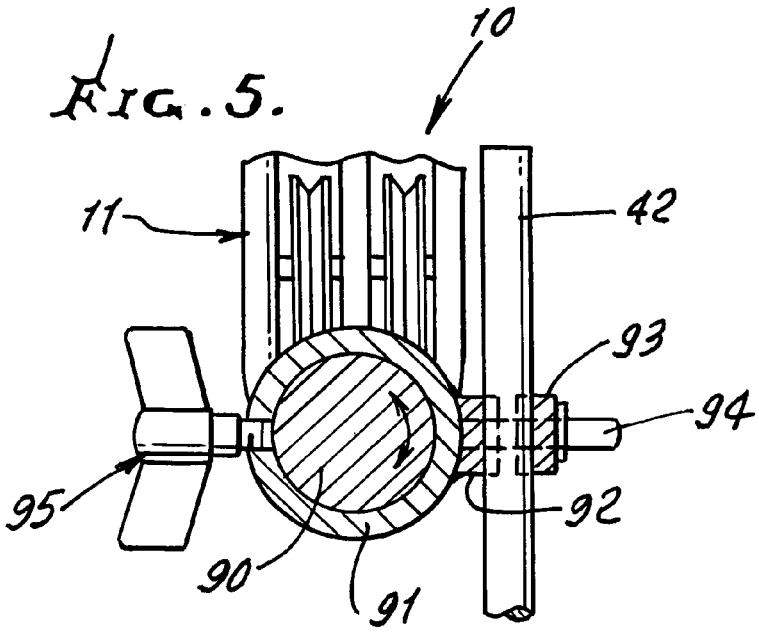
FIG. 5 is a section taken through a modified form of the invention, the tambourine extending vertically.
Figure 6:
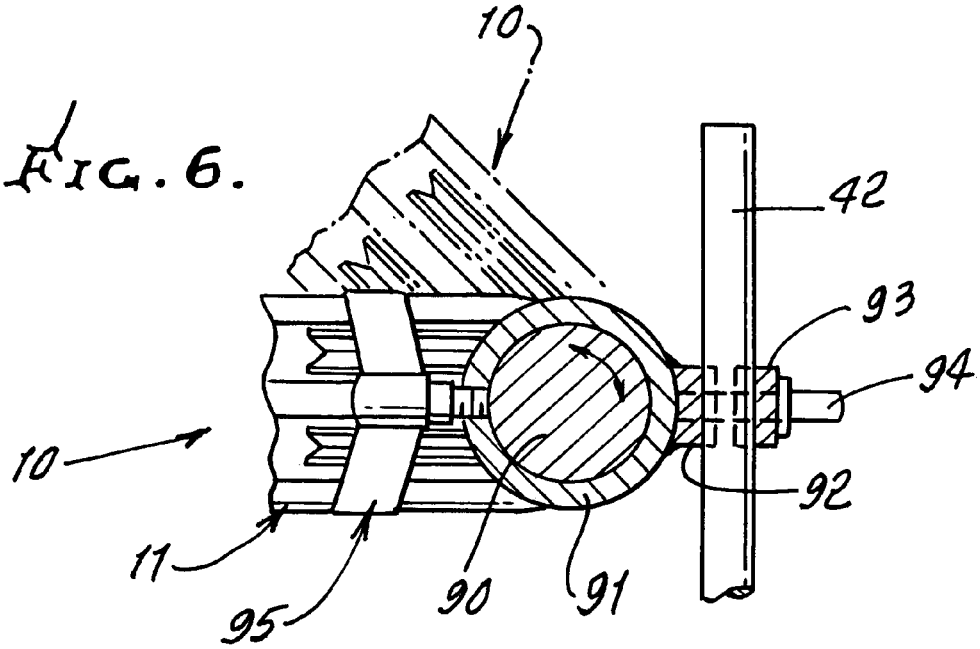
FIG. 6 is a view like FIG. 5, but showing the tambourine extending horizontally.

In FIGS. 5 and 6, the tambourine handle 90 is rotatable in a cylindrical sleeve 91 that carries the fixed clamp part 92, whereby the tambourine can be rotated to any selected tilt position. Movable clamping part 93 is moved toward part 92 when the threaded member or members 94 are rotated, as before, for clamping the sleeve to the rod 42. A set screw 95 clamps the sleeve to the rotatable tambourine handle 90. FIGS. 5 and 6 show vertical and horizontal positions, as well as other positions of the tambourine.

I claim:

1. A tambourine structure comprising in combination a) a frame extending at least in part along an extended path, b) multiple jingles carried by the frame at selected locations along said path, c) and means carried by the frame to connect the frame to support structure selectively in each of at least two different positions, d) each of said clamping elements including a fixed clamping element and a movable clamping element, said elements defining V-shaped grooves to receive said support structure therebetween.

2. The combination of claim 1 wherein said positions are i) frame substantially horizontal position ii) frame substantially vertical position.

3. The combination of claim 1 wherein said means includes first and second clamping elements corresponding to said two different positions.

4. The combination of claim 1 including a stand for supporting said means, and carrying said support structure.

5. The combination of claim 1 including said support structure which comprises a vertically extending rod.

6. The combination of claim 1 wherein said frame includes a tambourine handle to which said fixed clamping elements are connected.

7. The combination of claim 6 wherein said fixed clamping elements include two pairs of parallel projections, one pair projecting vertically and the other pair projecting horizontally, each movable clamping element received on one of said pairs for clamping advancement toward its associated fixed element.

8. The combination of claim 7 wherein said projections are threaded members for tightening the movable elements against the rod, in said different positions.

9. The combination of claim 8 wherein said threaded members have threaded connection to the movable elements for advancing them toward the fixed elements in response to rotation of the members.

10. The combination of claim 1 wherein the tambourine frame has adjustable tilt connection to a handle which is clamped to said support structure.

11. The combination of claim 1 wherein the tambourine frame has adjustable tilt connection to a sleeve, which is releasably clamped to said support structure.

12. The method of use of the structure as defined in claim 3 including attaching one of the first and second clamping elements to the support and so that the tambourine extends in one position, playing the tambourine, then detaching said one of the clamping elements from the support end, attaching the other of the first and second clamping elements to the support so that the tambourine extends in another position and playing the tambourine.

* * * * *